US007245090B2

(12) United States Patent
Yang

(10) Patent No.: US 7,245,090 B2
(45) **Date of Patent: *Jul. 17, 2007**

(54) SWITCHING LED DRIVER WITH TEMPERATURE COMPENSATION TO PROGRAM LED CURRENT

(75) Inventor: Ta-Yung Yang, Milpitas, CA (US)

(73) Assignee: System General Corporation, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/268,536

(22) Filed: Nov. 8, 2005

(65) Prior Publication Data

US 2007/0103095 A1 May 10, 2007

(51) Int. Cl.
*G05F 1/00* (2006.01)

(52) U.S. Cl. ..... 315/307; 315/291; 315/224; 315/169.1; 323/282; 323/283; 323/267

(58) Field of Classification Search .. 315/169.1–169.3, 315/276, 291, 307, 224; 363/13, 21.01, 21.05, 363/21.09, 21.13, 21.15, 21.17, 21.18; 345/82, 345/204, 212, 213; 323/282–284, 322; 327/9, 327/124, 126, 148, 166
See application file for complete search history.

(56) References Cited

U.S. PATENT DOCUMENTS 5,642,130 A * 6/1997 Browne ..... 345/111
6,721,192 B1 * 4/2004 Yang et al. ..... 363/21.18
6,798,152 B2 * 9/2004 Rooke et al. ..... 315/209 R
6,801,028 B2 * 10/2004 Kernahan et al. ..... 323/283
6,836,415 B1 * 12/2004 Yang et al. ..... 363/21.01
6,888,383 B1 * 5/2005 Fairbanks ..... 327/124
7,116,294 B2 * 10/2006 Stopa ..... 345/82
2005/0151708 A1 * 7/2005 Farmer et al. ..... 345/82
2006/0214603 A1 * 9/2006 Oh et al. ..... 315/246

OTHER PUBLICATIONS

U.S. Appl. No. 11/265,284, by Yang, filed Nov. 3, 2005.*

* cited by examiner

*Primary Examiner*—Haissa Philogene
(74) *Attorney, Agent, or Firm*—Rosenberg, Klein & Lee

(57) ABSTRACT

The present invention provides a LED driver for control the brightness of the LED. An energy-transferred element and a switch are connected in series with the LED for controlling the current of the LED. A diode is coupled to the energy-transferred element for freewheeling the energy of the energy-transferred element through the LED. A control circuit is developed to generate a control signal for switching the switch in response to the LED current. The LED current is further adjusted in response to a voltage signal of the LED. The value of the voltage signal is correlated to the LED temperature. Therefore the LED current can be programmed in accordance with the LED temperature.

13 Claims, 5 Drawing Sheets

SWITCHING LED DRIVER WITH TEMPERATURE COMPENSATION TO PROGRAM LED CURRENT

BACKGROUND OF THE INVENTION

1. Field of Invention

The present invention relates to a LED (light emission diode) driver, and more particularly to a control circuit for controlling the LED.

2. Description of Related Art

The LED driver is utilized to control the brightness of LED in accordance with its characteristics. The LED driver is utilized to control the current that flows through the LED. A higher current increases the intensity of the brightness, but decreases the life of the LED. FIG. 1 shows a traditional circuit of the LED driver. The voltage source 10 is adjusted to provide a current $I_{LED}$ to the LEDs 20~25 through a resistor 15. The current $I_{LED}$ can be shown as equation (1):

$$I_{LED} = \frac{V - V_{F20} - V_{F21} - \ldots - V_{F25}}{R_{15}} \quad (1)$$

wherein the $V_{F20}$~$V_{F25}$ are the forward voltage of the LEDs 20~25 respectively.

The drawback of the LED driver shown in FIG. 1 is the variation of the current $I_{LED}$. The current $I_{LED}$ is changed in response to the change of the forward voltages of $V_{F20}$~$V_{F25}$. The forward voltages of $V_{F20}$~$V_{F25}$ are not a constant due to the variation of the production and operating temperature. The second drawback of the LED driver shown in FIG. 1 is the power loss occurred on the resistor 15.

FIG. 2 shows another traditional approach of the LED driver. A current source 35 is connected in series with the LEDs 20~25 to provide a constant current to the LEDs 20~25. However, the disadvantage of this circuit is the power loss of the current source 35, particularly, as the voltage source 30 is high and the LED voltage drops of $V_{F20}$~$V_{F25}$ are low. Besides, a chromaticity and a luminosity of the LED are affected by the change of the LED's operating temperature. In order to keep the chromaticity and/or the luminosity of the LED as a constant, the current of the LED should be adjusted in response to the change of the temperature. The major objective of the present invention is to provide a LED driver to achieve a higher efficiency. The second objective of the present invention is to develop a LED driver capable of compensating the influence of the temperature.

SUMMARY OF THE INVENTION

The present invention provides a switching LED driver to control the brightness of the LED. The LED driver comprises a magnetic device such as an energy-transferred element connected in series with the LED, and a switch is coupled in series to the LED and the energy-transferred element for controlling a LED current. A control circuit is coupled to generate a control signal in response to a voltage signal of the LED and the LED current. A first resistor is connected in series with the LED to sense the LED current and generate a LED current signal coupled to the control circuit. A diode is coupled to the LED and the energy-transferred element for discharging the energy of the energy-transferred element through the LED. The control signal is utilized to control the switch and the LED current. Therefore the switch is turned off once the LED current is higher than a first threshold, and the switch is turned on after a period of a programmable delay time once the LED current is lower than a second threshold. Besides, the first threshold is varied in response to the voltage signal of the LED. The value of the voltage signal shows a LED forward voltage that is correlated to the LED temperature. Therefore the LED current can be programmed to compensate the chromaticity and the luminosity variations in accordance with the LED temperature.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings, FIG. 1 shows a traditional LED driver;

DESCRIPTION OF THE PREFERRED EMBODIMENT

Figure 1:
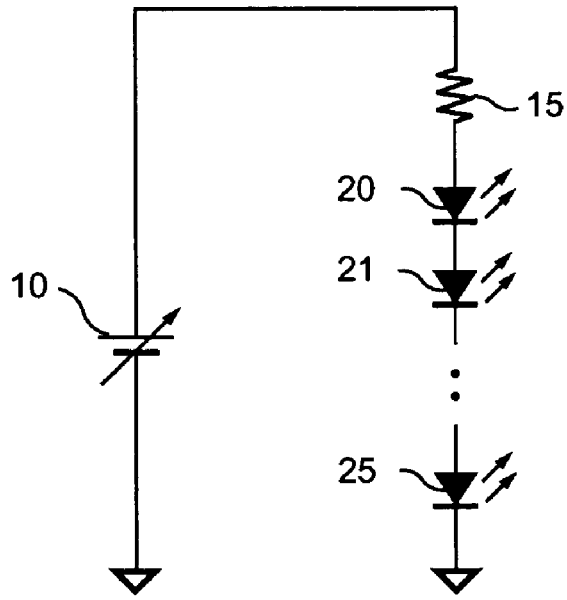
FIG. 1 (Prior Art)
Figure 2:
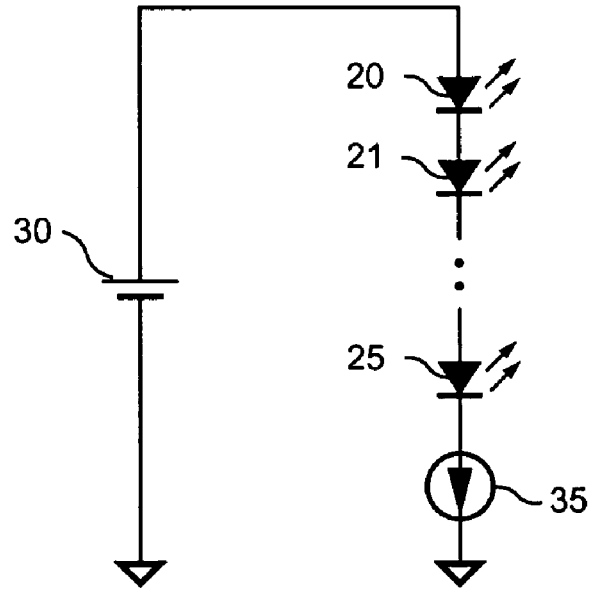
FIG. 2 (Prior Art)
FIG. 2 shows another traditional LED driver.
Figure 3:
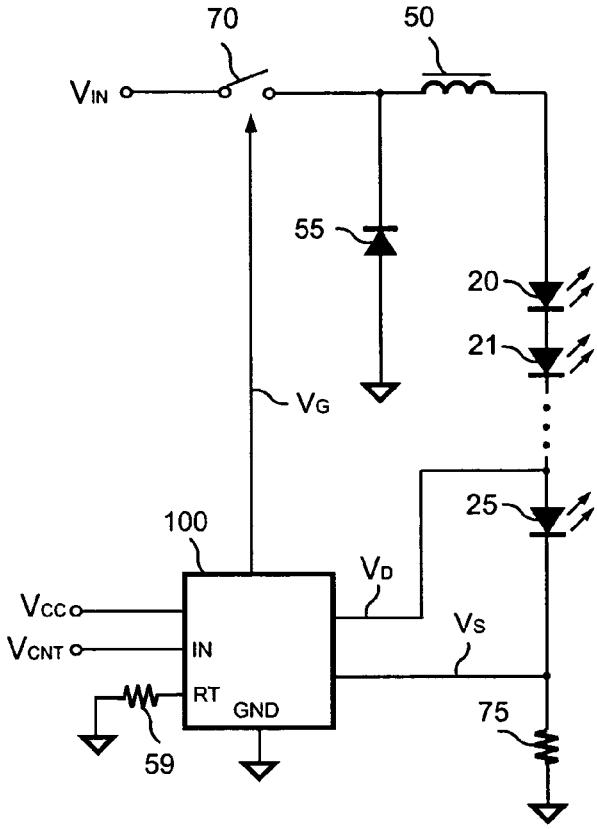
FIG. 3 shows a switching LED driver in accordance with present invention.

FIG. 3 shows a switching LED driver in accordance with present invention, in which an energy-transferred element 50 is coupled in series with the LEDs 20~25. A switch 70 is coupled in series to the LEDs 20~25 and the energy-transferred element 50 for controlling the LED current. Through a first resistor 75, the LED current is further converted to a current signal $V_S$ coupling to a control circuit 100. The control circuit 100 is further coupled to the LED to receive a voltage signal of the LED. A diode 55 is coupled to the LEDs 20~25 and the energy-transferred element 50. Once the switch 70 is turned off, the energy of the energy-transferred element 50 is discharged through the LEDs 20~25 and the diode 55. Meanwhile the control circuit 100 detects the forward voltage of the LED. The forward voltage of the LED is decreased in proportion to the increase of the LED temperature. Accordingly the voltage signal of the LED shows the variation of the LED temperature. For limiting the LED current, the switch 70 is turned off once the LED current is higher than a first threshold $V_R$. The maximum LED current can be expressed as equation (2):

$$I_{LED(MAX)} = \frac{V_{IN} - V_{F20} - \ldots - V_{F25}}{L_{50}} \times T_{ON} \quad (2)$$

where the $L_{50}$ is the inductance of the energy-transferred element 50; $T_{ON}$ is the on time of the switch 70.

Figure 4A:
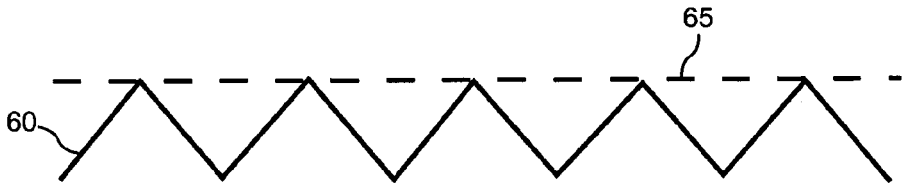
FIGS. 4A and 4B shows a LED current waveforms in accordance with present invention.
Figure 4B:
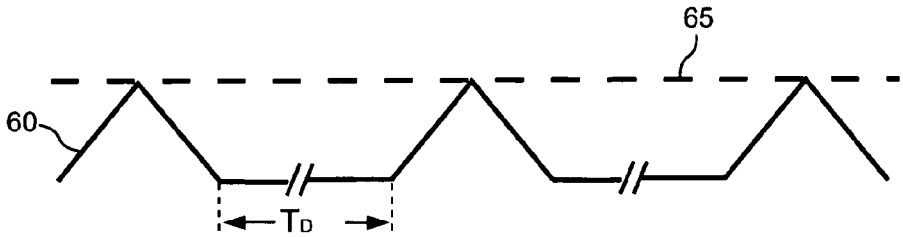

FIGS. 4A and 4B show the LED current waveform 60, in which the maximum value 65 of the first threshold $V_R$ limits the peak value of the LED current. The switch 70 is turned on to enable the LED current in response to the current signal $V_S$ is lower than a second threshold $V_{TH}$. The LED current is thus controlled as a triangle waveform. The maximum value 65 of the first threshold $V_R$ determines the average value of the LED current. Consequently the average value of the LED current is controlled as a constant despite the inductance variation of the energy-transferred element 50. Furthermore, the time delay $T_D$ is programmed to control value of the LED current and the brightness of the LEDs 20~25.

The control circuit 100 is utilized to generate a control signal $V_G$ to control the switch 70 and the LED current in response the LED current and the voltage signal of the LED. In order to keep the chromaticity and the luminosity of the LED as a constant, the LED current should be adjusted in reference to the LED temperature. According to present invention, the first threshold $V_R$ and the voltage signal of the LED are correlated to the LED current and the LED temperature respectively. The first threshold $V_R$ is controlled and varied in response to the voltage signal of the LED for the chromaticity and the luminosity compensation. Furthermore, for adapting various LEDs, a second resistor 59 is coupled to the control circuit 100 to determine the slope of the adjustment. The slope stands for 'the change of the first threshold $V_R$' versus 'the change of the voltage signal of the LED'.

Figure 5:
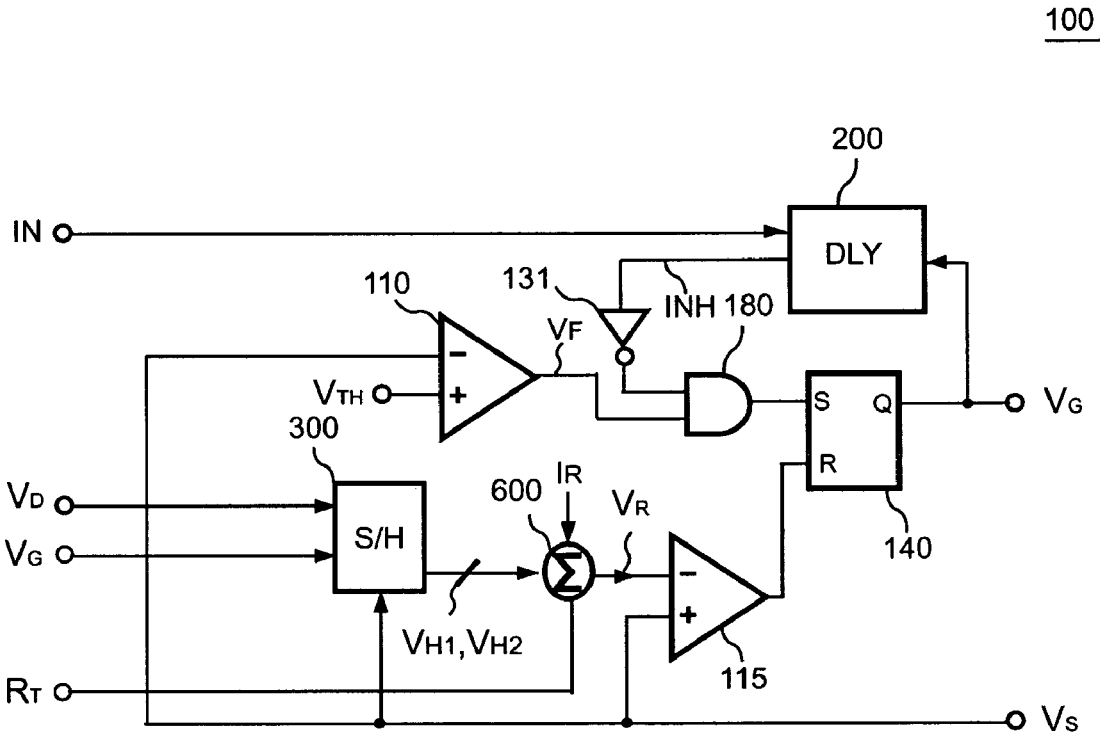
FIG. 5 shows a control circuit of the switching LED driver in accordance with present invention.

FIG. 5 shows a circuit schematic of the control circuit 100. The first threshold $V_R$ is coupled to turn off the control signal $V_G$ once the current signal $V_S$ is higher than the first threshold $V_R$. An enable signal $V_F$ is coupled to turn on the control signal $V_G$ once the current signal $V_S$ is lower than the second threshold $V_{TH}$. The voltage signal $V_D$ is produced by the voltage signal of the LED. A first control circuit including an AND gate 180, an inverter 131 and a flip-flop 140 generate the control signal $V_G$ in response to a delay signal INH and the enable signal $V_F$. The output of the AND gate 180 is connected to enable the flip-flop 140. The control signal $V_G$ is generated at the output of the flip-flop 140. A second control circuit 115 is applied to disable the control signal $V_G$ once the current signal $V_S$ is higher than the first threshold $V_R$. The output of the second control circuit 115 is connected to disable the flip-flop 140. A delay circuit 200 generates the delay signal INH having the time delay $T_D$ in response to the off-state of the control signal $V_G$. The delay signal INH is connected to the input of the AND gate 180 through the inverter 131. The control signal $V_G$ is disabled during the period of the time delay $T_D$. A sample circuit 300 is coupled to sample the voltage signal $V_D$ and generate a first-sampled signal $V_{H1}$ and a second-sampled signal $V_{H2}$. A constant current $I_R$ is supplied to a current adjust circuit 600 to generate the first threshold $V_R$. The first-sampled signal $V_{H1}$ and the second-sampled signal $V_{H2}$ are connected to the current adjust circuit 600 to program the value of the first threshold $V_R$. A comparison circuit 110 is applied to produce the enable signal $V_F$ once the current signal $V_S$ is lower than a second threshold $V_{TH}$. The enable signal $V_F$ is connected to the input of the AND gate 180 enabling the control signal $V_G$.

Figure 6:
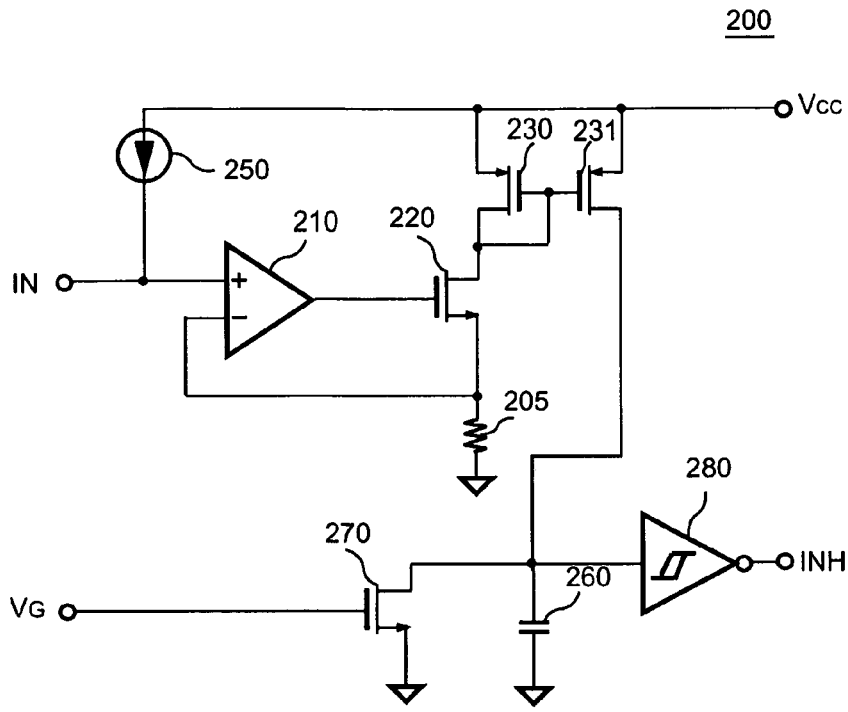
FIG. 6 shows a delay circuit that controls the brightness of LED in accordance with present invention.

FIG. 6 shows the delay circuit 200 that controls the brightness of the LED. A constant current source 250 is connected to an input terminal IN of the control circuit 100. The input terminal IN is developed to program the brightness of the LED. A resistor connected from the input terminal IN to ground and/or a control voltage $V_{CNT}$ connected to the input terminal IN will program the value of the time delay $T_D$. A operational amplifier 210, a resistor 205, transistors 220, 230 and 231 form a voltage-to-current converter for generating a charge current at transistor 231 in reference to the voltage at the input terminal IN. A transistor 270 is connected to discharge a capacitor 260. The input of the transistor 270 is connected to the control signal $V_G$. The charge current is coupled to charge the capacitor 260 in response to the off-state of the control signal $V_G$. The input of in inverter 280 is connected to the capacitor 260. The output of the inverter 280 generates the delay signal INH.

Figure 7:
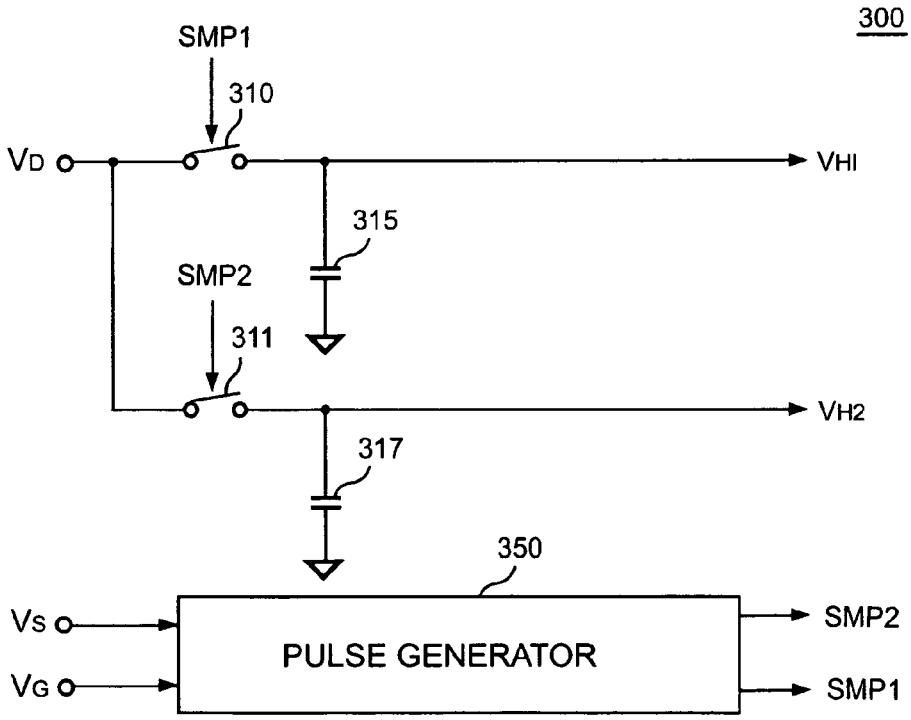
FIG. 7 shows a sample circuit of the control circuit in accordance with present invention.
Figure 8:
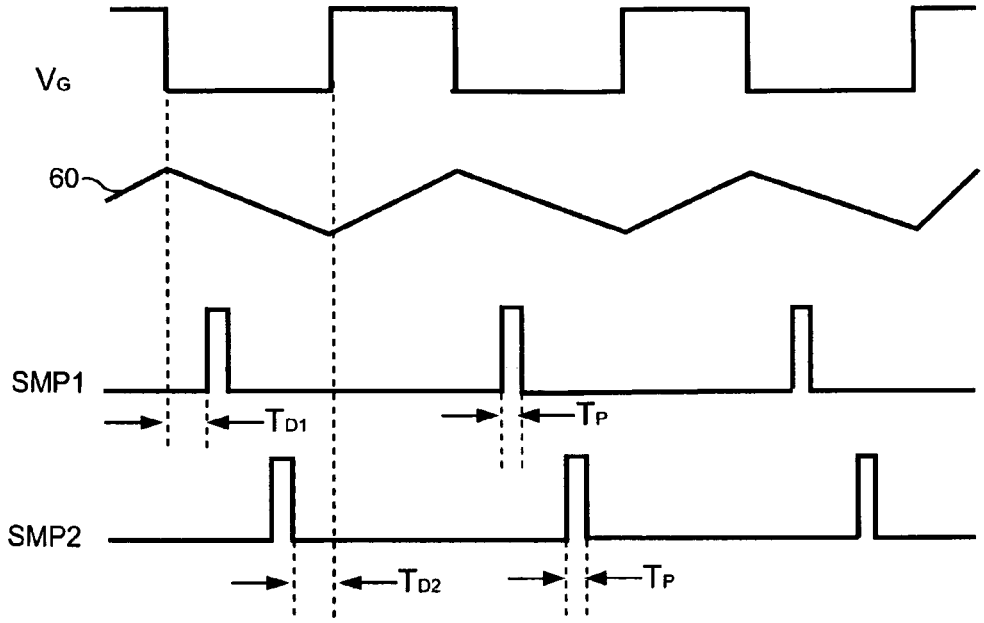
FIG. 8 shows signal waveforms of the control circuit in accordance with present invention.

FIG. 7 shows the sample circuit 300 of the control circuit 100. A pulse generator 350 generates a first pulse SMP1 and a second pulse SMP2 in response to the current signal $V_S$, the off-state of the control signal $V_G$ and the voltage signal $V_D$. FIG. 8 shows the signal waveforms, in which the first pulse SMP1 is produced after the control signal $V_G$ is in off-state. A delay time $T_{D1}$ ensures that the voltage signal $V_D$ is stable before enabling of the first pulse SMP1. A delay time $T_{D2}$ ensures that the second pulse SMP2 is produced before the current signal $V_S$ falling to zero. The first pulse SMP1 and the second pulse SMP2 are coupled to control the on/off-state of a switch 310 and a switch 311. The switch 310 and the switch 311 are coupled to sample the voltage signal $V_D$ and generate the first-sampled signal $V_{H1}$ and the second-sampled signal $V_{H2}$ on capacitors 315 and 317 respectively. Therefore the first-sampled signal $V_{H1}$ and the second-sampled signal $V_{H2}$ represent a first forward voltage of the LED and a second forward voltage of the LED in response to a first LED current $I_1$ and a second LED current $I_2$ respectively.

Figure 9:
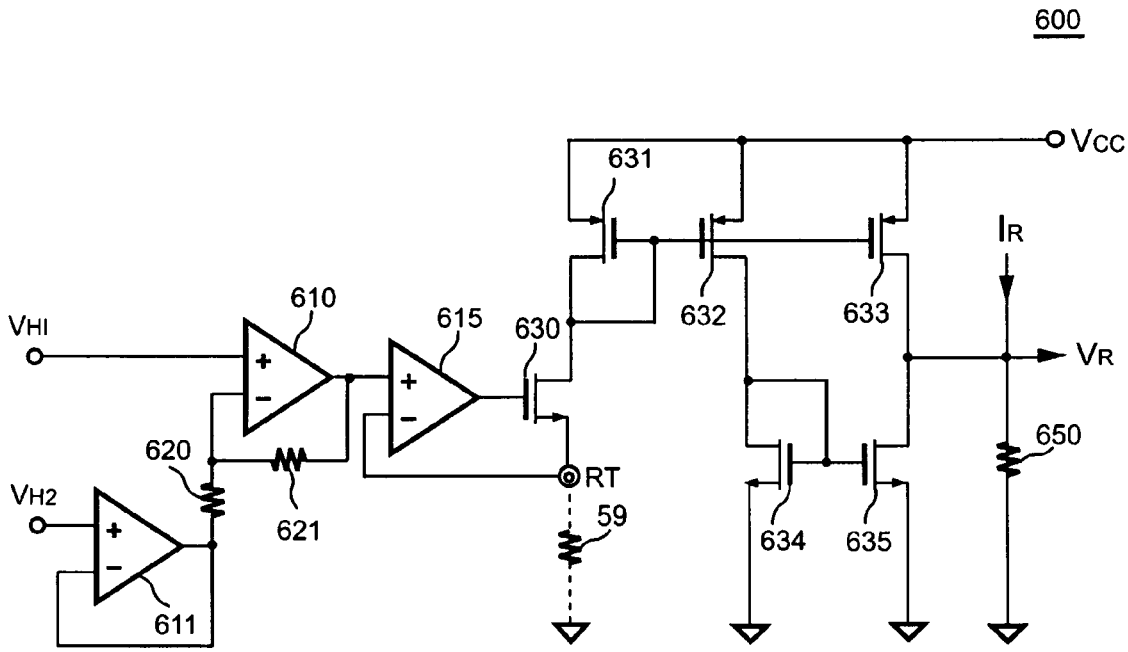
FIG. 9 shows a current adjust circuit in accordance with present invention.

The current adjust circuit 600 is shown in FIG. 9. Operational amplifiers 610, 611 and resistors 620, 621 develop a differential circuit. The first-sampled signal VH1 and the second-sampled signal $V_{H2}$ are connected to the differential circuit. The differential value of the first-sampled signal $V_{H1}$ and the second-sampled signal $V_{H2}$ is produced at the output of the operational amplifier 610. The output of the operational amplifier 610 is further coupled to the input of an operational amplifier 615. The operational amplifier 615, transistors 630~635 and the resistor 650 form another voltage-to-current converter to generate currents $I_{633}$ and $I_{635}$ in proportion to the resistance of the resistor 59 and the differential value of the first-sampled signal $V_{H1}$ and the second-sampled signal $V_{H2}$. A resistor 650 associated with the constant current $I_R$ generates the first threshold VR. The current $I_{633}$ and the current $I_{635}$ are connected to the resistor 650 to adjust the first threshold VR. The first-sampled signal $V_{H1}$ and the second-sampled signal $V_{H2}$ correspond to the first forward voltage $V_1$ and the second forward voltage $V_2$.

The first forward voltage $V_1$ and the second forward voltage $V_2$ correspond to the first LED current $I_1$ and the second LED current $I_2$. The current $I_1$ and $I_2$ are given by equation (3) and (4):

$$I_1 = I_0 \times e^{V1/VT} \tag{3}$$

$$I_2 = I_0 \times e^{V2/Vt} \tag{4}$$

where $$VT = \frac{k \times \text{Temp}}{q};$$

k is the Boltzmann's constant; q is the charge on an electron; and $T_{emp}$ is the absolute temperature. More, $T_{emp}$ is shown as equation (5):

$$\text{Temp} = \frac{q}{k} \times \frac{V_1 - V_2}{\ln\left(\frac{I_1}{I_2}\right)} \tag{5}$$

Forgoing equations show the LED temperature can be accurately detected from the voltage signal $V_D$. The LED temperature is further used for programming the LED current and compensating the chromaticity and the luminosity of the LED.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A LED driver comprising:

an energy-transferred element, connected in series with a LED;

a switch, coupled in series to the LED and the energy-transferred element for controlling a LED current;

a control circuit, generating a control signal in response to a voltage signal of the LED and the LED current;

a diode, coupled to the LED and the energy-transferred element for discharging the energy of the energy-transferred element through the LED;

a first resistor, connected in series with the LED to sense the LED current and generate a LED current signal coupled to the control circuit; and a second resistor, connected to the control circuit to determine a slope of the adjustment, in which the slope represents the change of a first threshold versus the change of the LED current of the LED;

wherein the control signal is used to control the switch and the LED current, wherein the switch is turned off once the LED current is higher than the first threshold, and the first threshold is varied in response to the voltage signal of the LED, and the switch is turned on after a period of a programmable delay time once the LED current is lower than a second threshold.

2. The LED driver as claimed in claim 1, the control circuit comprising:

a first control circuit, enabling the control signal in response to a delay signal and an enable signal;

a second control circuit, disabling the control signal once the LED current signal is higher than the first threshold;

a comparison circuit, producing the enable signal once the LED current signal is lower than the second threshold;

a delay circuit, generating the delay signal having the programmable delay time in response to the off-state of the control signal, in which the control signal is disabled during the period of the programmable delay time; and a sample circuit, generating a first-sampled signal and a second-sampled signal in response to the voltage signal of the LED;

wherein the first-sampled signal and the second-sampled signal are used to adjust the first threshold.

3. The LED driver as claimed in claim 2, wherein the first-sampled signal and the second-sampled signal represent a first forward voltage of the LED and a second forward voltage of the LED in response to a first LED current and a second LED current respectively.

4. A LED driver comprising:

an energy-transferred element, connected in series with a LED;

a switch, coupled in series to the LED and the energy-transferred element for controlling a LED current;

a control circuit, generating a control signal in response to a voltage signal of the LED and the LED current;

a diode, coupled to the LED and the energy-transferred element for discharging the energy of the energy-transferred element through the LED; and a first resistor, connected in series with the LED to sense the LED current and generate a LED current signal coupled to the control circuit;

wherein the control signal is used to control the switch and the LED current, wherein the switch is turned off once the LED current is higher than a first threshold, wherein the switch is turned on after the LED current is lower than a second threshold.

5. The LED driver as claimed in claim 4, wherein the first threshold is varied in response to the voltage signal of the LED.

6. The LED driver as claimed in claim 4, further comprising a second resistor connected to the control circuit to determine a slope of the adjustment, in which the slope represents the change of the first threshold versus the change of the LED current of the LED.

7. The LED driver as claimed in claim 4, the control circuit comprising:

a first control circuit, enabling the control signal in response to a delay signal, and an enable signal;

a second control circuit, disabling the control signal once the LED current signal is higher than the first threshold;

a comparison circuit, producing the enable signal once the LED current signal is lower than the second threshold;

a delay circuit, generating the delay signal having the programmable delay time in response to the off-state of the control signal; and a sample circuit, generating a first-sampled signal and a second-sampled signal in response to the voltage signal of the LED;

wherein the first-sampled signal and the second-sampled signal are used to adjust the first threshold.

8. The LED driver as claimed in claim 7, wherein the first-sampled signal and the second-sampled signal represent a first forward voltage of the LED and a second forward voltage of the LED in response to a first LED current and a second LED current respectively.

9. A LED driver comprising:

an energy-transferred element, connected in series with a LED;

a switch, coupled in series to the LED and the energy-transferred element for controlling a LED current;

a control circuit, generating a control signal in response to a voltage signal of the LED and the LED current; and a diode, coupled to the LED and the energy-transferred element for discharging the energy of the energy-transferred element through the LED;

wherein the control signal controls the switch and the LED current, wherein the switch is turned off once the LED current is higher than a first threshold.

10. The LED driver as claimed in claim 9, wherein the first threshold is varied in response to the voltage signal of the LED.

11. The LED driver as claimed in claim 9, further comprising:

a first resistor, connected in series with the LED to sense the LED current and generate a LED current signal coupled to the control circuit; and a second resistor, connected to the control circuit to determine a slope of the adjustment, in which the slope represents the change of the first threshold versus the change of the LED current of the LED.

12. The LED driver as claimed in claim 9, the control circuit comprising:

a first control circuit, enabling the control signal in response to a delay signal, and an enable signal;

a second control circuit, disabling the control signal once the LED current signal is higher than the first threshold;

a comparison circuit, producing the enable signal once the LED current signal is lower than the second threshold;

a delay circuit, generating the delay signal having the programmable delay time in response to the off-state of the control signal; and a sample circuit, generating a first-sampled signal and a second-sampled signal in response to the voltage signal of the LED;

wherein the first-sampled signal and the second-sampled signal are used to adjust the values of the first threshold.

13. The LED driver as claimed in claim 12, wherein the first-sampled signal and the second-sampled signal represent a first forward voltage of the LED and a second forward voltage of the LED in response to a first LED current and a second LED current respectively.

* * * * *